US006761779B2

(12) United States Patent
Delaunay et al.

(10) Patent No.: US 6,761,779 B2
(45) Date of Patent: Jul. 13, 2004

(54) PREHEATING OF METAL STRIP, ESPECIALLY IN GALVANIZING OR ANNEALING LINES

(75) Inventors: Didier Delaunay, Breuillet (FR); Alain Morel, Villeurbanne (FR)

(73) Assignee: Stein Heurtey (FR)

( * ) Notice: Subject to any disclaimer, the term of this patent is extended or adjusted under 35 U.S.C. 154(b) by 0 days.

(21) Appl. No.: 09/796,355

(22) Filed: Mar. 2, 2001

(65) Prior Publication Data

US 2002/0162612 A1 Nov. 7, 2002

(30) Foreign Application Priority Data

Mar. 8, 2000 (FR) ..... 00 02990

(51) Int. Cl.[7] ..... C21D 1/00
(52) U.S. Cl. ..... 148/559; 266/156
(58) Field of Search ..... 148/559; 266/156

(56) References Cited

U.S. PATENT DOCUMENTS 5,314,170 A * 5/1994 Tada et al. ..... 266/156

FOREIGN PATENT DOCUMENTS

| | | | |
|---|---|---|---|
| DE | 3238546 | | 6/1983 |
| EP | 0 630 978 | A1 | 12/1994 |
| FR | 2 083 823 | | 12/1970 |
| FR | 2 406 667 | | 10/1978 |
| JP | 06212285 | * | 8/1994 |
| JP | 06287643 | * | 10/1994 |

* cited by examiner

*Primary Examiner*—Sikyin Ip
(74) *Attorney, Agent, or Firm*—Connolly Bove Lodge & Hutz LLP

(57) ABSTRACT

A method is disclosed for preheating a metal strip in at least one direct fired preheating section of a furnace for limiting the oxidation of the metal strip. The method includes installing burners in the preheating section along its length for establishing a plurality of preheating sub-zones of unit length corresponding to one burner. The air and fuel settings for each burner are adjusted in accordance with a desired heat demand. Subsequent steps include operating a variable number of downstream burners at full power to establish a preheating zone of variable length to produce the desired heat demand, and extinguishing a second variable number of upstream burners to establish a corresponding variable recovery zone.

1 Claim, 2 Drawing Sheets

PREHEATING OF METAL STRIP, ESPECIALLY IN GALVANIZING OR ANNEALING LINES

FIELD OF THE INVENTION

The present invention relates to improvements to the preheating of metal strip, especially steel strip, in direct-fired preheating sections installed, in particular, at the entry point of hot-galvanizing lines or in annealing lines.

BACKGROUND OF THE INVENTION

It is known that the direct-fired preheat before galvanizing or annealing, as carried out at the present time, fulfils three functions:

heating the strip;

removing the residues of rolling or protective oils present when the line is not fitted with a precleaning section; and limiting or eliminating oxidation of the steel strip, inherent in burner heating.

In continuous lines produced according to the prior art, the preheating is carried out in a series of several zones, the temperature of which is controlled independently, usually four zones for high-capacity lines and two zones for low-capacity lines, each of these zones being fitted, for example, with four to six burners on each side of the furnace.

Strip galvanized or annealed in continuous lines varies in grade, width or thickness and it also runs at variable speeds. This has an effect on the heat demand of the furnace zones which may vary significantly. To allow for this variable heat demand, for example when the strip cross section is small or its speed is low, generally only a small number of these preheating zones are used, by shutting down the first zones in the direction of advance of the strip or by keeping them at a minimum thermal output equivalent to about 15 to 20% of their rated power.

In the latter case, particularly for preheating thinner products, little power is used.

To fully understand the technical problem solved by the present invention, reference should be made to FIG. 1 of the appended drawings, which shows, schematically, in side elevation, an embodiment of a preheating plant comprising two preheating zones. Associated with this FIG. 1 is FIG. 1A which shows the heating power used in the two preheating zones and the curve showing the variation in temperature of the strip in the said zones.

FIG. 1 shows that the plant for preheating the strip 1 comprises two preheating zones 2 and 3. Each of these zones is fitted with burners 4 fed with combustion air via a manifold 5 and with fuel via a manifold 7. The power injected in each zone is controlled by valves for adjusting the flow rate of oxidizer and fuel, respectively 6 and 8. In this example, the heating power represented by the hatched area in the graph in FIG. 1A corresponds to 60% of the rated power of the second zone 3, the first zone 1 operating at its minimum power, for example 15%. Curve 9 shows the temperature rise of the strip in the preheating zones. Under these conditions, the temperature of the gas and of the walls of the second preheating zone 3 stabilizes at low levels, of around 1150° C. or less.

It is known that oxidation of the strip is lower the higher the ambient temperature or the temperature of the walls of the zone of the direct-fired preheat furnace. In this regard, reference may in particular be made to the article "*Direct-fired heating in continuous hot-dip galvanizing lines*" published in No. 4/1991 of "MPT-Metallurgical Plant and Technology International", FIG. 2 of which is included in the appended drawings. Plotted in this figure on the y-axis is the thickness of the oxide layer formed on the surface of the strip, expressed in ångströms, as a function of the gas temperature or the wall temperature in the zone of the furnace, plotted on the x-axis, for a 650° C. exit temperature of the strip leaving the preheat zone. This figure shows that the formation of oxides is a maximum for gas or wall temperatures of 1150° C. and that it is much less for gas or wall temperatures above 1250° C.

It may also be seen that operation of the furnace under such operating conditions as are mentioned above puts the strip in a situation which maximizes its oxidation.

The oxidation formed on the surface of the strip under these conditions must be removed. This requires fitting, downstream of the preheat zone, a hold zone in an atmosphere containing hydrogen, this hold zone being long enough for the oxides formed to be removed by reduction. This reduction must be carried out at high temperature, which usually requires reheating the strip to levels which are often achieved only for the purpose of obtaining this reduction, although they are not necessary for the metallurgical treatment of the steel grade of the strip.

This lack of flexibility in controlling the heat supply in the preheat according to the prior art and the impossibility of placing the strip under conditions in which its oxidation can be limited generally results in strip temperatures which are the consequence of poor matching of the line to the operating conditions in question. The furnace design also stems from these imperfections and results in the production of long lines with substantial cooling equipment. It is obvious that this additional furnace length increases the cost of the plant, its size and both the maintenance and running costs.

BRIEF DESCRIPTION OF THE INVENTION

The objective of the present invention was to solve the above-mentioned technical problem by providing a novel process and an improved furnace for heating strip in direct-fired preheat sections with limited oxidation, for all production configurations (line speed, treatment characteristics, product characteristics, especially grade and cross section).

Moreover, this invention, apart from the improvement in the quality of the end-product that it provides, solves the problem of the plant size encountered in the abovementioned prior art, given that its implementation makes it possible to reduce the dimensions and consequently the costs of the annealing or galvanizing lines to which it is applied.

Consequently, this invention relates in the first place to a process for preheating metal, especially steel, strip in direct-fired preheating sections for the purpose of limiting the oxidation of the heated metal strip, whatever the production configurations, which consists in using a preheating zone that can be divided, along its length, into a plurality of zones of unit length corresponding to one burner, it being possible for each of the said burners to be operated individually under fixed conditions so as to accurately adjust its air/gas setting, and therefore the resulting atmosphere in the furnace, characterized in that a certain number of burners starting from the downstream end of the preheating zone are ignited, the length of the furnace zone affected by the ignition of the said burners and the length of the recovery zone, i.e. the zone in which the burners are extinguished, being variable depending on the heat demand and in that each burner operates at full power and with a constant air/gas setting.

Implementing the process forming a subject of the invention as specified above gives, in particular, the results below which are impossible to achieve with the equipment according to the prior art, for all line speeds:

- the strip is heated in a preheating zone whose length can be varied, but the temperature and atmosphere conditions are optimal with regard to oxidation, this being so however the line is operated, for all strip or treatment-cycle characteristics, and the length of the preheating zone thus defined is tailored to the tonnage produced by the treatment line (such as an annealing or galvanizing line), whatever the cross section of the products treated or the speed of the said line;
- the burners all operate under conditions and with a setting such that they provide optimum flame geometry and characteristics with regard to the chemical treatment that has to be carried out on the surface of the strip.

It will be understood that the novelty of the process forming a subject of the present invention stems from the simultaneous use of a certain number of characteristics (control of the burners in on/off or proportional mode, preheating zone with variable lengths, tailored air/gas burner feed ratio) in a configuration such that the operating sensitivity of the line thus produced makes it possible to improve the quality of the end-product over very wide production ranges.

According to the present invention, the ambient and wall temperature of the preheating zone is above 1100° C., preferably between 1250 and 1300° C.

According to one method of implementing the present invention, applied to the heat treatment of strip, the exit temperature of the preheating zone is tailored to this treatment, thereby making it possible to limit the length of the cooling zones installed downstream of the preheating zone, or even to dispense with them.

According to another method of implementing the present invention, applied to the heat treatment of steel strip, the minimum exit temperature of the preheat zone is tailored to this treatment so as to limit the length of the cooling zones provided downstream of the preheating zone or even, where appropriate, to dispense with them.

This invention also relates to a furnace for implementing the process as specified above, which comprises a preheating zone divided into a plurality of zones of unit length each corresponding to a burner, each of the said burners being operated individually under fixed conditions, characterized in that each burner is controlled individually by means of valves acting on the oxidizer feed and by means of valves acting on the fuel feed so as to ignite a number of burners, starting from the downstream end of the preheating zone, which corresponds to the heat demand and in that the said burners operate at full power and with a constant air/gas setting.

Further features and advantages of the present invention will become apparent from the description given below with reference to the figures of the appended drawings illustrate, respectively, a plant a cording to the invention and the curve showing the variation in the temperature of th strip for a preheat exit temperature identical to that in FIG. 1A.

DETAILED DESCRIPTION OF THE INVENTION

In FIG. 3, the same references are used to denote the elements similar to those described above with reference to FIG. 1.

FIG. 3 shows that according to the invention the sectioning of the preheating zone into conventional regulating zones of the prior art, which group together several burners, is replaced with the sectioning of this preheating zone into a plurality of zones of unit length corresponding to one burner. The burners are operated by a separate regulating system that may be of the conventional proportional type or of the on/off type.

In this embodiment, the preheating zone is sectioned into two preheating zones fed with oxidizer and fuel via manifolds 5 and 7, it being possible for each of the burners 4 of the two preheating zones to be operated individually by means of valves 10 acting on the oxidizer circuit and by valves 11 acting on the fuel circuit. These valves may be operated in proportional mode so as to vary the injected power by varying the oxidizer or fuel flow rates, or in on/off mode, the injected-power setting in the zone then being adjusted by the ratio of the time that the burner is operating to the time that it is not operating, or else adjusted by choosing the number of burners in service at full power.

It is thus possible, according to the invention, to operate a number of burners corresponding to the heat demand of the furnace at full power so that the zone in which these burners are fitted is raised to the required temperature level, for example 1300° C. This heat demand is measured and controlled by a furnace-regulating system which ignites the corresponding number of burners, these burners operating at full power. In the example in question, the four burners fitted at the exit of the preheating zone operate permanently at 100% of their rated capacity, the fifth burner of this zone adjusting the amount of power injected either by regulating its flow rate in proportional mode or by adjusting its operating time.

The variations in the heat demand of the furnace, connected with the changes in speed or in cross section of the product to be treated, result in an increase or a decrease in the number of burners ignited, and therefore in a variation in the length of the zone in which the temperature conditions are combined so as to maintain the strip in a temperature zone in which its oxidation is lessened. The zone in which the burners are not operating then behaves as a recovery zone extending that which exists upstream of the preheat.

Figure 1:
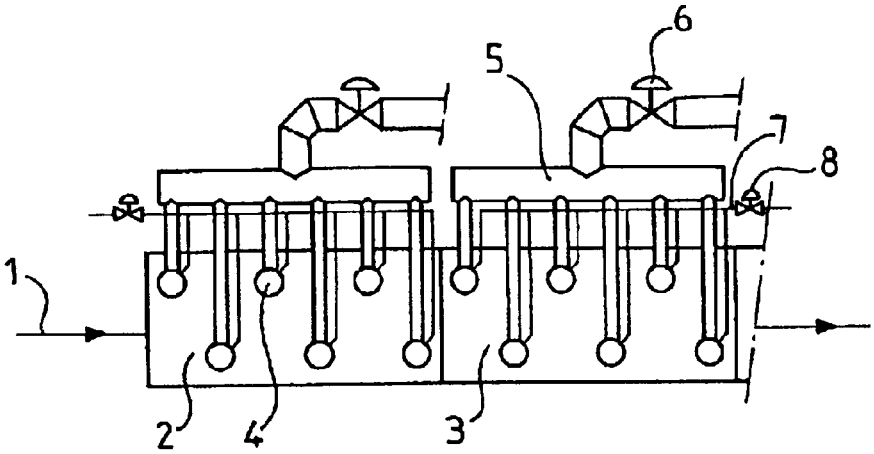
FIG. 1 is a schematic illustration of a prior art metal treatment plant.
Figure 1A:
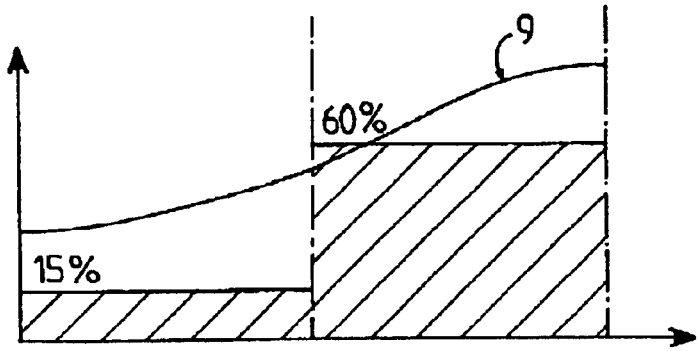
FIG. 1A is a plot of temperature variation of a metal strip in the preheating zones of the plant of FIG. 1.
Figure 2:
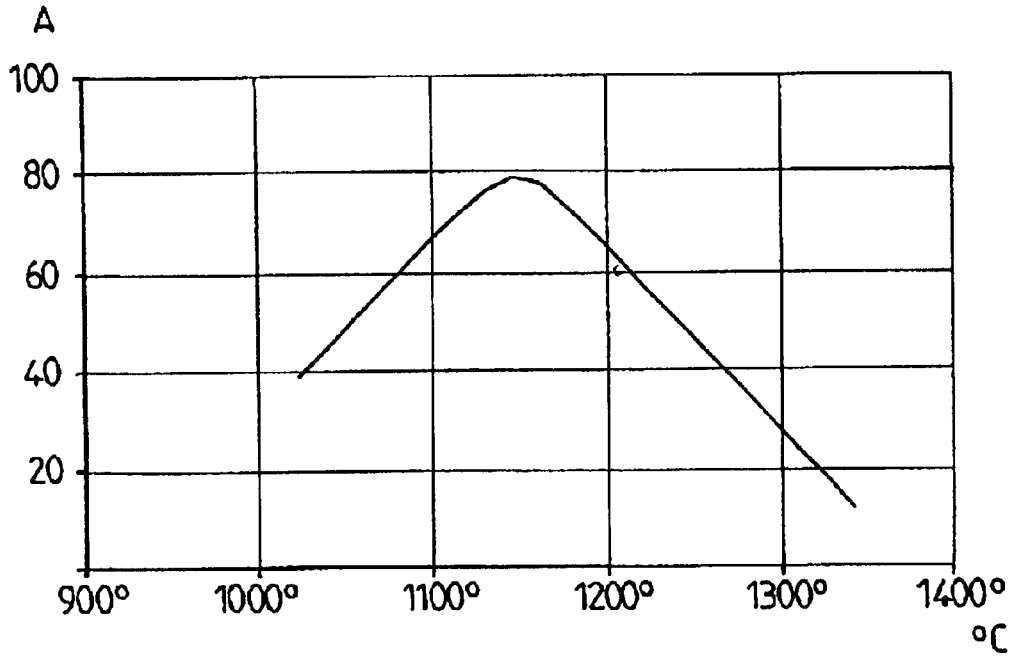
FIG. 2 is a plot of oxide thickness as a function of preheat zone temperature.
Figure 3:
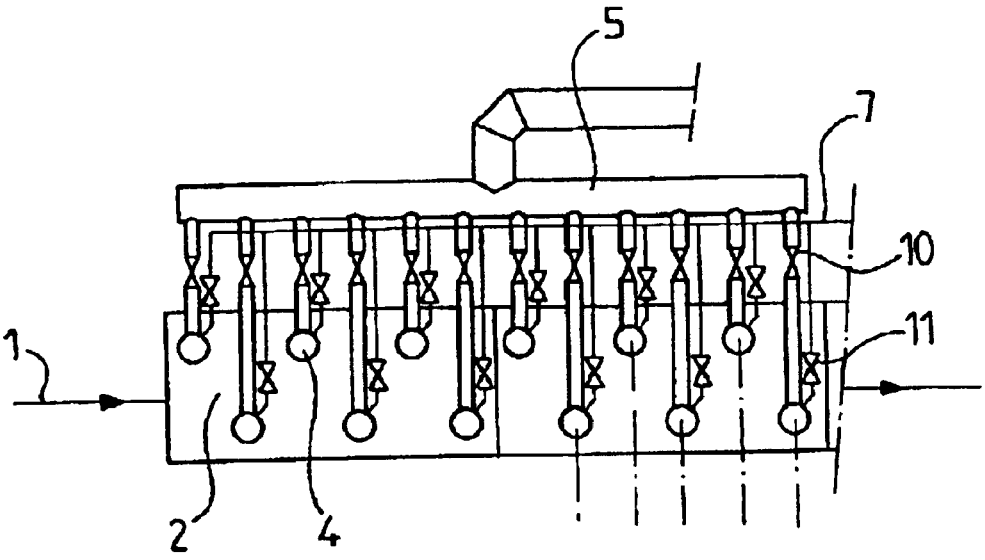
FIG. 3 is a schematic illustration of a metal treatment plant of the invention.
Figure 3A:
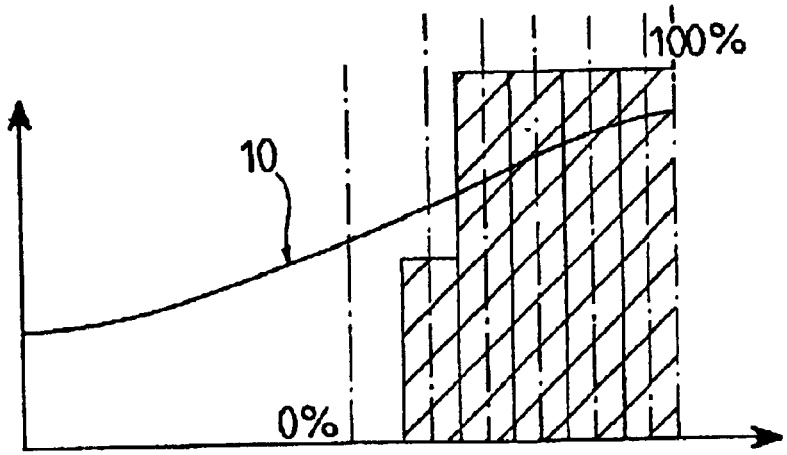
FIG. 3A is a plot of temperature variation of a metal strip in the preheating zones of the plant of FIG. 3.

Plotted in FIG. 3A is the curve showing the change in the strip temperature for a preheat exit temperature identical to that in FIG. 1A.

The final temperature range of the strip for which the oxidation is lessened is put to good use to optimize the length of the furnace. For example, for hot-rolled steel, an exit temperature of 500° C. of the strip leaving the preheating zone will be chosen, this temperature being sufficient for its treatment, instead of the 650° C. temperature conventionally imposed by the preheating means according to the prior art. It is obvious, with the strip not being so hot, that the cooling equipment located on the downstream side of the line will be smaller, further reducing the size of the equipment and therefore its cost.

It is also possible, by virtue of the process forming a subject of the invention, to heat a strip of mild steel, for example of commercial grade, to temperatures of about at least 730° C. without increasing its oxidation, thereby making it possible to further decrease the length of the complementary heating zone in a reducing atmosphere which is conventionally used downstream of the preheating zones in treatment lines according to the prior art, or even of dispensing with this complementary heating zone. This reduction in the length of the complementary heating zone in a reducing atmosphere will also have a direct impact on the size and on the cost of the equipment.

For all types of product to be treated, limiting the amount of oxidation by implementing the process forming a subject of the invention makes it possible to reduce the residence time of the strip in a reducing atmosphere, and hence, again, to reduce the length of the line or to decrease the amount of hydrogen in this zone where the reduction of the oxides takes place.

In all cases, lessening the oxidation of the strip by implementing the process forming a subject of the invention makes it possible to improve the quality of the end-product, its surface finish and the quality of the coating produced, for example, on galvanizing lines.

The process forming a subject of the invention allows low-temperature treatment cycles to be carried out because of the possibility of limiting the oxidation of the strip in the preheat:

it is no longer necessary to overheat the strip to reduce the oxides formed, thereby allowing the possibility of carrying out low-temperature cycles—this being an advantage resulting in a decrease in the energy consumption and shorter furnaces;

when the treatment cycle is carried out at low temperature, it is possible to reduce, or even dispense with, the strip-cooling equipment downstream of the lines; and as the oxidation is limited, the time needed to reduce the oxides is shorter, and therefore the downstream furnace is shorter. Likewise, when the oxidation in the preheat is lessened, it is possible to heat the strip to a higher temperature in this zone, and therefore to reduce the length of the heating zone in a reducing atmosphere.

It is clear from a reading of the above description that the present invention makes it possible to produce heat treatment plants which are more versatile, more efficient and less expensive than the plants according to the prior art.

Of course, it remains to state that the invention is not limited to the embodiments or methods of implementation described and/or illustrated here, but rather it encompasses all variants thereof.

What is claimed is:

1. A method for preheating metal strip in at least one direct fired preheating section of a furnace operating at a desired heat demand of the preheating section while limiting oxidation of the metal strip, the method comprising the steps:

moving the strip through the preheating section;

installing burners in the preheating section along its length for establishing a plurality of preheating subzones of unit length corresponding to one burner;

individually controlling the air and fuel settings for each burner to obtain an ambient and wall temperature of the preheating zone that is between 1250° and 1300° C., and a strip temperature of 500° C. at the exit of the preheating section.

* * * * *